United States Patent [19]

Norstrom

[11] 4,126,148

[45] Nov. 21, 1978

[54] DEGREASING APPARATUS

[75] Inventor: Göte J. W. Norström, Karlstad, Sweden

[73] Assignee: Uddeholms Aktiebolag, Hagfors, Sweden

[21] Appl. No.: 831,600

[22] Filed: Sep. 8, 1977

[30] Foreign Application Priority Data

Sep. 30, 1976 [SE] Sweden ..... 7610875

[51] Int. Cl.[2] ..... B08B 3/10

[52] U.S. Cl. ..... 134/135; 134/164; 202/170

[58] Field of Search ..... 202/170, 170 D; 134/105, 108, 135, 140, 164

[56] References Cited

U.S. PATENT DOCUMENTS

| | | | |
|---|---|---|---|
| 1,771,698 | 7/1930 | Wolff | 202/170 D |
| 2,280,811 | 4/1942 | Edhofer et al. | 202/170 X |
| 2,983,062 | 5/1961 | Smith | 134/140 X |
| 3,151,620 | 10/1964 | Kellard | 134/140 X |
| 3,286,718 | 11/1966 | Kumpf | 134/135 X |
| 3,615,824 | 10/1971 | Hittel et al. | 134/105 X |

FOREIGN PATENT DOCUMENTS

| | | | |
|---|---|---|---|
| 545,300 | 3/1956 | Belgium | 134/164 |

*Primary Examiner*—Robert L. Bleutge

*Attorney, Agent, or Firm*—Toren, McGeady and Stanger

[57] ABSTRACT

In a degreasing apparatus the articles to be degreased are placed in a holder fastened to two sprocket wheels. Each sprocket wheel is suspended in an endless chain. Movable sprocket wheels connected by a wire to a winding chain provided to form at least one loop on each endless chain, resulting in the holder being lifted from a lower position in a degreasing solvent to an upper position outside the solvent. A motor driving a sprocket wheel in turn drives a chain which is trained over a stationary sprocket wheel for rotating the stationary sprocket wheel engaging the endless chain, resulting in the holder being rotated irrespective of its position in the apparatus.

2 Claims, 1 Drawing Figure

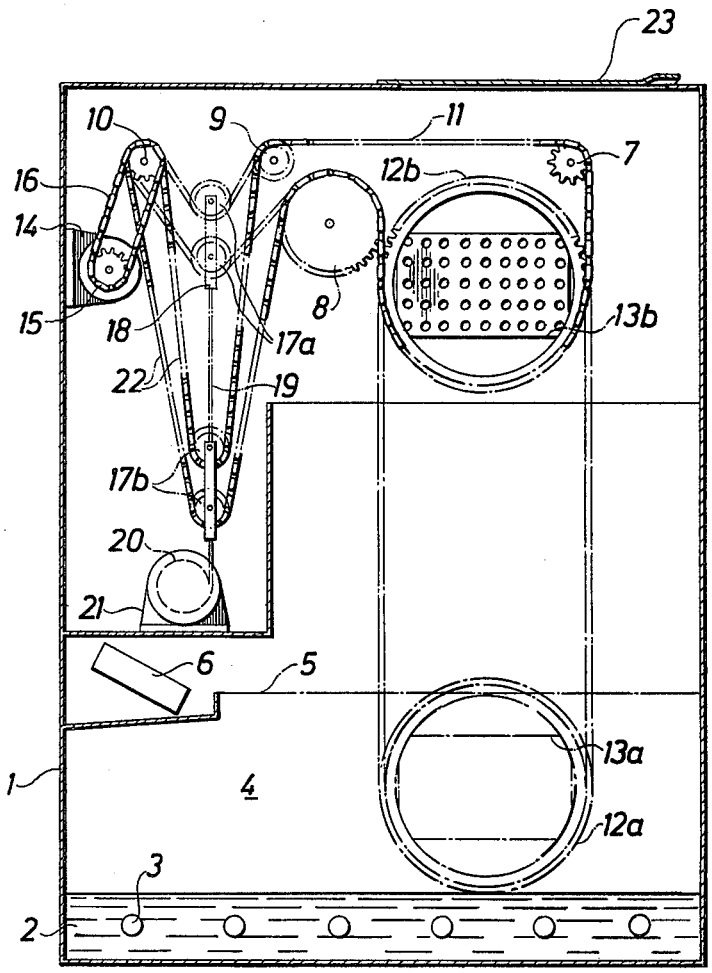
23
10
9
11
7
16
12b
14
8
13b
15
18
17a
22
19
17b
20
21
6
5
13a
1
4
12a
3
2

DEGREASING APPARATUS

The invention relates to a degreasing apparatus of the type comprising a container for liquid or vaporised solvent, a holder for objects to be degreased, and a lifting means to lower the holder into and lift it out of the solvent. A chlorinated hydrocarbon such as trichoroethylene is normally used as solvent. The solvent may be in liquid form, or the cold objects may be lowered into vapour from the solvent, which then condenses on the objects, thus dissolving grease and oil.

The object of the invention is to achieve an apparatus in which the holder for the objects to be degreased can be caused to rotate irrespective of vertical movement in the solvent. Such a rotary movement is desirable so that the solvent can reach all parts of the surface of the objects, and also so that is can drain off satisfactorily.

The degreasing apparatus according to the invention is characterized in that the lifting means comprises two wheels, preferably sprocket wheels, the wheels being fastened to the holder, two endless belts, preferably chains, supporting the wheels, a pulling means to form at least one loop on each of the endless belts, the size of the loop determining the level of the holder, and a drive means for at least one stationarily arranged roller over which at least one of the endless belts is arranged to run, so that the wheels with the holder can be caused to rotate irrespective of the level at which they are hanging.

The invention will be explained in the following with reference to the drawing which shows a vertical cross section through an apparatus according to the invention.

The apparatus comprises a container 1 with a space 2 at the bottom for liquid solvent. The solvent can be brought to boil with the help of electric immersion heaters 3. The vapour formed produces a vapour zone 4. The upper limit 5 of this zone is determined by a cooler 6 on which the vapour condenses. The condensate runs back into the liquid zone 2. In the upper part of the container 1 four rollers in the form of sprocket wheels 7–10 are arranged close to each of two opposite walls. An endless chain 11 passes over these four sprocket wheels. Each chain also passes around and supports a sprocket wheel 12. The wheels are secured to a holder 13 for the objects to be degreased. The holder 13 consists of a basket with perforated walls and a lockable lid. The holder 13 and the two wheels 12 attached thereto thus form a unit which is carried by the two endless chains 11. The holder 13 is accessible by opening a lid 23 in the top of the container 1.

A motor 14 is fitted in the upper part of the container 1, this motor driving the sprocket wheel 10 via a sprocket wheel 15 and a chain 16. The endless chain 11 is thus put in motion, and the wheels 12 and holder 13 will consequently start rotating.

Two sprocket wheels 17 are arranged to engage the two parts of the endless chain 11 between the stationary sprocket wheels 9 and 10. The sprocket wheels 17 are fitted on a holder 18 secured to a wire 19 which can be wound by a motor 21 onto a winding drum 20 located approximately half way up the container 1. When the sprocket wheels 17 are pulled down, the endless chain 11 will be pulled down to form two loops 22. The loop carrying the wheel 12 will thus be shortened a corresponding length, and the wheels 12 with the holder 13 will therefore be lifted at a speed which is twice that of the sprocket wheels 17. When the sprocket wheels 17 are at their highest point **17*a*, the wheels 12 are at their lowest point 12*a*, i.e. in the vapour zone 4. When the sprocket wheels 17 are at their lowest level 17*b*, the wheels 12 are at their highest level 12*b* in the upper part of the container 1 where degreased objects can be removed from the holder 13** and oily objects be inserted for degreasing.

It is clear from the above description that the hoisting movement of the holder 13 can be performed entirely independently of its rotary movement. The holder 13 with the objects inside can therefore be caused to rotate whenever desired during the degreasing process, preferably when in the vapour zone 4 and when it is lifted up to its upper position when degreasing is complete.

The apparatus shown can be varied in many ways within the scope of the invention. It may, for instance, be designed for degreasing in only liquid solvent, or in both liquid and vapour solvent. Furthermore, the pulling means formed by the motor 21 winding drum 20 and sprocket wheels 17 may be constructed in some other manner. It may be arranged to pull out four loops of the endless chain 11, for instance. However, taking into account the space available in the container 1, the embodiment illustrated is preferred.

What I claim is:

1. Degreasing apparatus comprising a container (1) for liquid or vaporised solvent, a holder (13) for objects to be degreased, a lifting means to lower the holder (13) into and lift it out of the solvent, the lifting means comprising two wheels (12), preferably sprocket wheels, secured to the holder (13) and two belts (11), preferably chains, supporting said wheels (12), as well as a rotary means to cause the wheels (12) with the holder (13) to rotate, characterized in that the two belts (11) are endless, that the lifting means consists of means (17–21) to form at least one loop (22) on each of said endless belts (11), the size of the loop (22) determining the level of said holder (13), and that the rotary means consists of a drive means (14–16) for at least one stationarily arranged roller (10) over which at least one of the endless belts (11) is arranged to run, so that the wheels (12) with the holder (13) can be caused to rotate irrespective of the level at which they are hanging.

2. Degreasing apparatus according to claim 1, characterized in that the loop-forming means (17–21) is arranged to pull out two loops (22) on each of the endless belts (11) in vertical direction downwards, the pulling means comprising a winding drum (20) driven by a motor (21), a wire (19) extending substantially vertically upwardly from the winding drum, and two rollers (17) in connection with the wire (19) which are arranged to engage the two loops (22).

* * * * *